United States Patent [19]

Brown

[11] Patent Number: 4,702,181

[45] Date of Patent: Oct. 27, 1987

[54] CYCLONE SEPARATOR

[75] Inventor: Melvin H. Brown, Allegheny Township, Westmoreland County, Pa.

[73] Assignee: Aluminum Company of America, Pittsburgh, Pa.

[21] Appl. No.: 934,424

[22] Filed: Nov. 24, 1986

[51] Int. Cl.[4] ..... F23D 1/02

[52] U.S. Cl. ..... 110/264; 55/459 A; 406/173; 431/158

[58] Field of Search ..... 55/459 R, 459 A, 337; 406/173; 110/264; 431/158

[56] References Cited

U.S. PATENT DOCUMENTS

| | | | |
|---|---|---|---|
| 3,676,987 | 7/1972 | Wunder et al. | 55/459 R |
| 3,870,493 | 3/1975 | Kall et al. | 55/459 X |
| 4,128,406 | 12/1978 | Spevack | 55/459 X |

*Primary Examiner*—Edward G. Favors

*Attorney, Agent, or Firm*—Thomas J. Connelly

[57] ABSTRACT

A cyclone separator is disclosed for effectively separating a gaseous or liquid medium from solid particles or for separating two or more similar substances by size or weight. The cyclone separator includes a chamber having a cylindrical member closed off by lower and upper end walls. A first inlet is tangentially formed in a lower portion of the cylindrical chamber and provides a means for introducing a first substance, for example, a carbonaceous fuel. A second inlet is also tangentially formed in a lower portion of the cylindrical chamber above and at an inclined angle to the first inlet. A second substance, for example, pressurized air, can be routed through the second inlet so as to combine with the fuel to form a combustible mixture. The mixture is circulated at a high velocity in an upwardly extending spiral path to promote burning and to produce combustible gas and ash. After the fuel has burned, the ash is removed from the cylindrical chamber through an oulet formed in the outer periphery of the upper wall while the hot combustible gas is removed through an outlet tube coaxially positioned within the cylindrical chamber. The outlet tube contains one or more peripheral openings which are sized and arranged to permit the combustible gas to enter the interior of the tube and be exhausted to the atmosphere. The surface adjacent to the peripheral openings can be curved to require a greater angular turn in order for a gas to enter the tube.

19 Claims, 6 Drawing Figures

CYCLONE SEPARATOR

FIELD OF THE INVENTION

This invention relates to a cyclone separator capable of separating a gaseous or liquid medium from solid particles or for classification of particles by size.

BACKGROUND OF THE INVENTION

In the separation of a gaseous or liquid medium from solid particles or in the classification of particles by size, there is a need for a relatively simple and efficient apparatus. For example, in the combustion of carbonaceous material containing sulfur and ash, such as coal, the gases of combustion may contain sulfur compounds representing a major portion of the sulfur found in the material, as well as ash particulates. Since sulfur compounds and particulates may constitute significant environmental hazards, much work has been devoted to the development of methods for preventing formation of these substances or cleansing them from the combustion gases.

Several patents which teach cyclone burners as well as processes for burning fuel to reduce emissions include U.S. Pat. Nos. 4,101,412; 4,232,615; 4,257,760; and 4,542,704. However, such equipment is not as efficient as the present cyclone separator which can reduce the percent of ash which is emitted from the separator along with the hot combustible gas. In addition, there is a need for a separator which can separate solid particles from a high temperature gas stream by elutriation. Such a device could find application above a fluid bed combustor or in fluid bed reaction systems.

Now a cyclone separator has been invented which requires the recoverable product to make a radius turn before leaving the separator. This required turn increases the centrifugal force acting on the solid particles and assists in separating them from the recoverable product.

SUMMARY OF THE INVENTION

Briefly, this invention relates to a cyclone separator which is capable of obtaining high heat release rates from a carbonaceous material and providing essentially an ash-free stream of hot combustible gas. The cyclone separator has a cylindrical combustion chamber which is closed at both ends. A first inlet is tangentially formed in a lower portion of the cylindrical member and serves as a conduit through which a pressurized stream of dry pulverized or water slurry carbonaceous material is fed. A second inlet is tangentially formed in the lower portion of the cylindrical member above the first inlet and at an inclined angle thereto. The second inlet directs a stream of pressurized air into the combustion chamber where it mixes with the fuel and facilitates circulation. The high velocity of the air causes the mixture to spiral in an upwardly extending path within the combustion chamber around the peripheral wall. This spiral path promotes burning of the carbonaceous material to produce combustible gas and ash. The ash is exhausted from the combustion chamber through an outlet which is formed in the upper end wall, preferably near its outer perimeter. The recoverable combustible gas is exhausted from the combustion chamber through an open ended tube which is coaxially positioned within the combustion chamber. The tube extends out of the top wall and is open at its upper end as well as having at least one peripheral opening formed along its longitudinal length. The opening requires an angular turn by the spirally circulating combustible gas in order for it to enter the tube. The angular turn assists in separating the combustible gas from the ash thereby enabling an essentially ash-free gas stream to exit the combustion chamber. The portion of the tube adjacent to the openings can be bowed outward to increase the angular turn which the combustible gas has to make.

The general object of this invention is to provide a cyclone separator which is capable of separating a gas or liquid from solid particulate. A more specific object of this invention is to provide a cyclone separator which is capable of separating ash-free combustible gas from ash.

Another object of this invention is to provide a cyclone separator which can efficiently burn a carbonaceous material and reduce the emission of ash particles and sulfur compounds which exit with the combustible gas.

A further object of this invention is to provide a cyclone separator which can burn either a dry pulverized carbonaceous material or a carbonaceous-water slurry.

Still another object of this invention is to provide a simple and inexpensive cyclone separator for separating like particles into two or more sizes.

Other objects and advantages of the present invention will become more apparent to those skilled in the art in view of the following description and the accompanying drawings.

DETAILED DESCRIPTION OF THE PREFERRED EMBODIMENTS

Even though this invention will be described in terms of a combustion chamber in which a combustible reaction occurs, one skilled in the art should realize that it is not limited to that use. The cyclone separator can be used to separate a gaseous or liquid medium from solid particles or to separate particles by mass weight, size, density, etc. or to classify particles according to a desired physical parameter.

Figure 1:
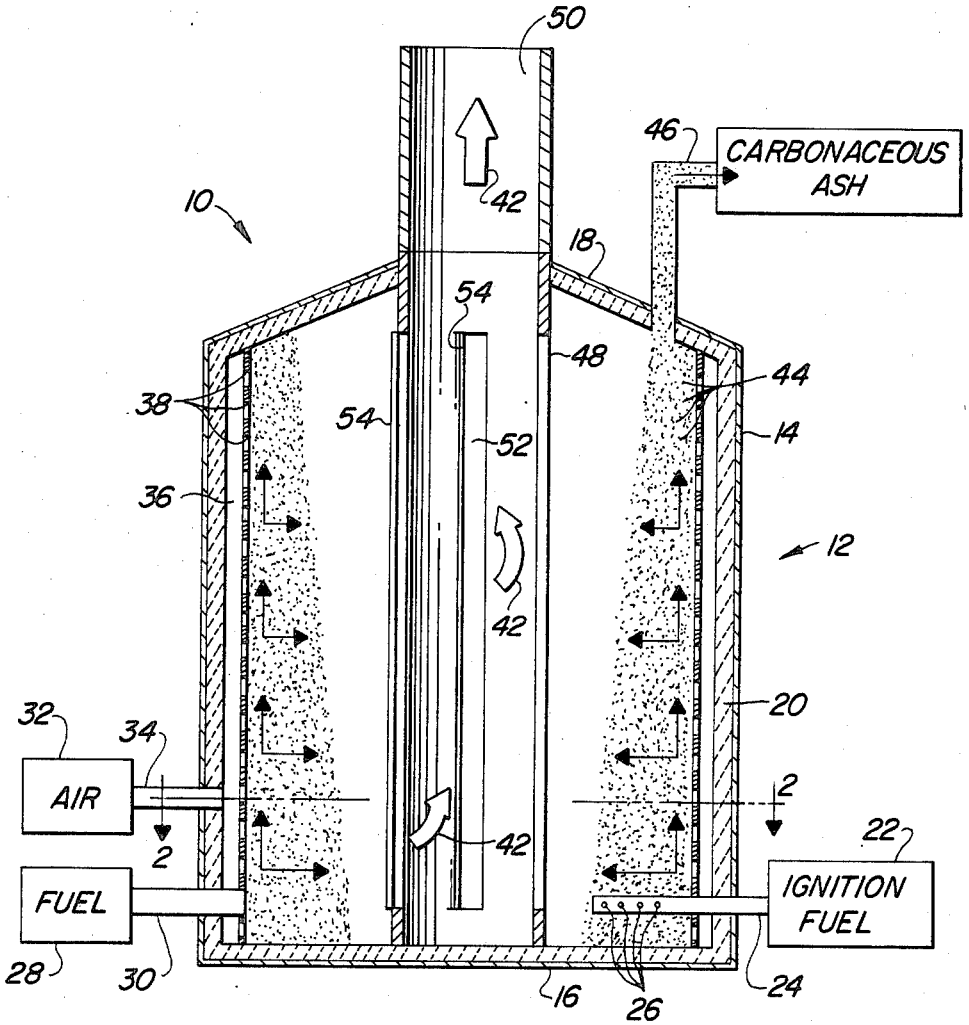
FIG. 1 is a cross-sectional view of a cyclone separator.
Figure 2:
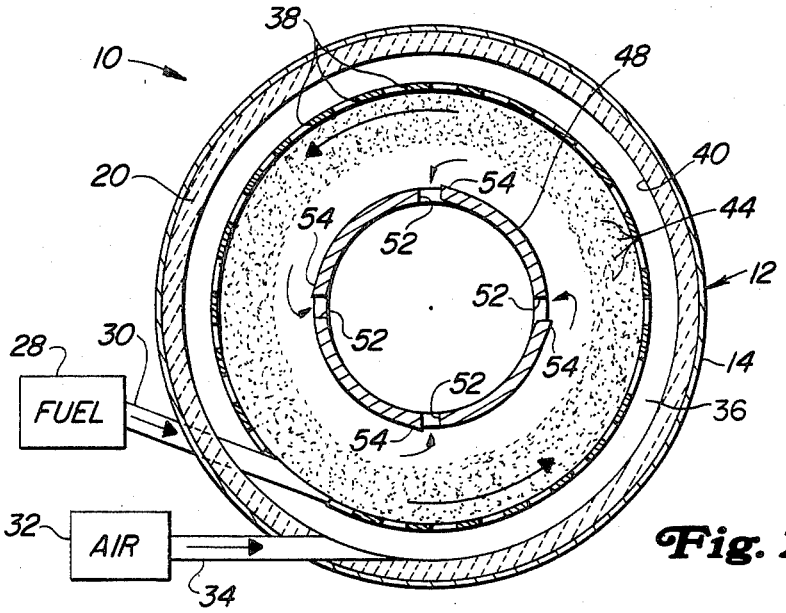
FIG. 2 is a top view of the cyclone separator shown in FIG. 1 taken along line 2—2 showing the tangential introduction of both fuel and air.

Referring to FIGS. 1 and 2, a cyclone separator 10 is shown which is capable of burning a carbonaceous material and separating essentially ash-free gas from the ash. The cyclone separator 10 contains a combustion chamber 12 having a cylindrical sidewall 14, a lower end wall 16 and an upper end wall 18. The lower and upper end walls, 16 and 18 respectively, close off the combustion chamber 12. The sidewall 14 is constructed of a metal, such as stainless steel, and is lined on its inner periphery with a refractory material 20, such as alumina or firebrick. Ignition fuel 22, for example gas or oil, is routed to a bottom portion of the combustion chamber 12 via a line 24 having a plurality of openings 26 formed along a portion of its length. The ignition fuel 22 is used to start combustion within the combustion chamber 12. It should be known to those skilled in the art that other means of starting combustion can be utilized.

Fuel 28, such as dry pulverized coal or a coal-water slurry having a temperature ranging between room temperature and 600° F., is fed into the combustion chamber 12 through an inlet line 30. The inlet line 30 is preferably tangentially formed in a lower portion of the combustion chamber 12. The carbonaceous fuel 28, which can include agglomerative coal, tar sand, shale, oil shale, organic portions of solid waste, heavy liquid hydrocarbons, sawdust, etc., is fed into the combustion chamber 12 as a pressurized stream at a pressure of at least 1 pound per square inch and at a velocity of from 1 to 200 feet per second. When a water slurry is used, the water content can range from 30% to 50%, depending upon the condition and temperature of the fuel 28. The fuel 28 can be fed into the combustion chamber 12 at room temperature or be preheated if desired. The size of the carbonaceous material should be limited to a particle size of less than 1000 microns in diameter. Preferably, the pulverized fuel 28 will have a diameter of less than 100 microns to facilitate ignition and combustion.

Pressurized air 32 having an adequate oxygen content is introduced into the combustion chamber 12 through an inlet line 34. This inlet line 34 is formed in a lower portion of the combustion chamber 12 above and at an inclined angle to the fuel inlet line 30. The air 32 is preferably tangentially introduced at a temperature ranging between room temperature and 1000° F., at a pressure of at least 1 psi and at a velocity of between 1 and 200 feet per second. The theoretical air percent can range between 75 and 100%. The air inlet line 34 is connected to an air chamber 36 which surrounds the combustion chamber 12 and has a plurality of openings 38 formed in an inner wall 40 thereof. The openings 38 serve to distribute the pressurized air 32 over the entire inner surface of the combustion chamber 12. The openings 38 can be sized so as to provide a desired air velocity along the height of the combustion chamber 12. It should be noted that although only one fuel inlet line 30 and one air inlet line 34 are shown in FIGS. 1 and 2, a plurality of fuel and air inlet lines 30 and 34 could be arranged about the periphery of the combustion chamber 12 if this is desired. When two or more fuel and air lines 30 and 34 are utilized, it is preferable to arrange them in an equally spaced apart manner. It is also possible to mix the fuel 28 and the air 32 upstream of the combustion chamber 12 and introduce both through a single inlet. The particular velocity of the incoming fuel and air will vary depending upon the size and configuration of the cyclone separator 10. However, to insure adequate mixing and combustion of the air—fuel mixture, it is recommended that the velocity of at least one of the streams be approximately 200 feet per second.

The fuel inlet line 30 and the air inlet line 34 are preferably formed in the lower 25% of the combustion chamber 12 and the air inlet line 34 is located above and at an inclined angle to the fuel inlet line 30. This arrangement facilitates thorough mixing of the fuel 28 and the air 32 and provides an upwardly extending spiral path within the combustion chamber 12. The spiral circulation promotes burning of the carbonaceous fuel 28 to produce combustible gas 42 and ash 44. The fuel 28 and its transformation to ash 44 is depicted in FIGS. 1 and 2 by a plurality of dots. As the burning fuel 28 and ash 44 rise within the combustion chamber 12, they are forced toward the peripheral wall 40 by centrifugal force. The centrifugal force causes the fuel 28 and ash 44 to move away from the center longitudinal axis of the combustion chamber 12 as it rises upward toward the upper end wall 18 in an inverted frusto-conical manner. An outlet 46 is formed in the upper end wall 18, preferably adjacent to its outer periphery, for removing the ash 44 from the combustion chamber 12.

The cyclone separator 10 also contains a cylindrical outlet tube 48 having an upper end 50 open to the atmosphere for permitting clean combustible gas 42 to be exhausted therefrom. The exhausted gas 42 can be recycled and used in a number of different applications since it will have a high heat content. Normally the exhaust gas 42 will have a temperature of between 600° and 2000° F. and more preferably between 600° and 1400° F. One use for the exhaust gas 42 is to heat the incoming air being introduced into the cyclone separator 10.

The outlet tube 48 can be constructed of a metal such as stainless steel but preferably is made of a refractory material, for example firebrick, which can withstand temperatures in excess of 2000° F. The outlet tube 48 extends through the upper end wall 18 of the combustion chamber 12 and has at least one peripheral opening 52 formed therein. The peripheral opening 52 can be radially aligned with the fuel inlet 30 so long as the fuel 28 is tangentially introduced into the combustion chamber 12. The peripheral opening 52 is shown in FIGS. 1 and 2 as a longitudinal slit having a uniform width of approximately ¼ inch for an outlet tube 48 having a diameter of about 4 inches. The vertical slit 52 extends from a point adjacent to the fuel inlet line 30 to a point adjacent to the upper end wall 18 of the combustion chamber 12.

In FIG. 2 it can be seen that there are four slits 52 which are spaced 90° apart and which have a length equal to roughly the vertical height of the combustion chamber 12. Preferably, when one or more longitudinal slits 52 are used, the length will be at least 75% of the vertical height of the combustion chamber 12. Although one can use a single opening 52, it is preferable to form two or more spaced apart openings in the periphery of the outlet tube 48. The openings 52 require an angular turn of the spirally circulating combustible gas 42 in order for it to enter the inner periphery of the outlet tube 48. This angular turn assists in separating the combustible gas 42 from the heavier ash particles 44. This separation permits essentially ash-free combustible gas 42 to exit from the combustion chamber 12. Laboratory experimentation on a model cyclone separator having a 1 foot diameter and using aluminum powder having a mesh of −325 as representative of the carbonaceous material showed that less than 3% of the alumina left the cyclone separator through the central outlet tube.

To assist in the separation of the combustible gas 42 from the ash 44, the outer surface of the tube 48 adjacent to the openings 52 can be curved or bowed outward to provide a convex portion 54 adjacent to one side of the openings 52. The convex portion 54 will require a greater angular turn of the combustible gas 42 before it can enter the inner periphery of the tube 48. Preferably, the bowed configuration will increase the required angular turn to about 100°. Good separation will occur when the gas 42 must make an angular turn of at least 90° and preferably greater than 135°. For a given centrifugal force, the greater the angular turn needed to enter the tube 48, the greater the amount of separation of the ash 44 from the gas 42.

Figure 3:
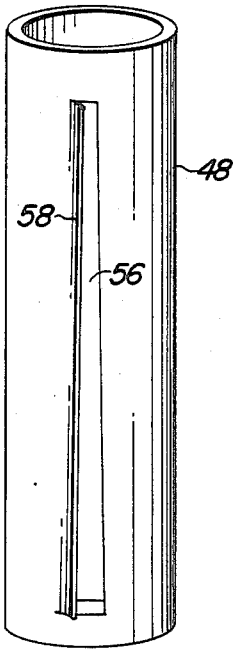
FIG. 3 is a perspective view of an outlet tube having a tapered opening which increases in width toward the lower end wall.

Referring to FIG. 3, an alternatively configured opening 56 is shown formed within the outlet tube 48. The opening 56 is a taper having a wide section near the lower end of the outlet tube 48 which tapers to a narrow section near the upper end of the tube 48. The tapered opening 56 can be sized to expel combustible gas 42 from the combustion chamber 12 at a constant velocity along its entire length if desired. The tapered opening 56 restricts the amount of combustible gas 42 that can enter adjacent to the upper portion of the combustion chamber 12 while providing a larger opening near the lower portion of the combustion chamber 12. This is advantageous in that the heavier fuel particles 28 which are present in the lower portion are forced outward away from the longitudinal center axis toward the peripheral wall 40 by the centrifugal force. As the fuel 28 burns or pyrolyzes within the combustion chamber 12, ash 44 is formed which is lighter in weight. The lightweight ash particles are affected less by the centrifugal force and therefore are likely to be in the central upper portion of the combustion chamber 12. The smaller openings in the upper portion of the outlet tube 48 decreases the likelihood that these ash particles 44 can exit with the combustible gas 42. One side of the taper opening 56 is preferably curved or bowed outward to provide a convex portion 58. The convex portion 58 serves the same function as the convex portion 54 in that it requires the gas 42 to make a greater angular turn in order to enter the inner periphery of the outlet tube 48.

Figure 4:
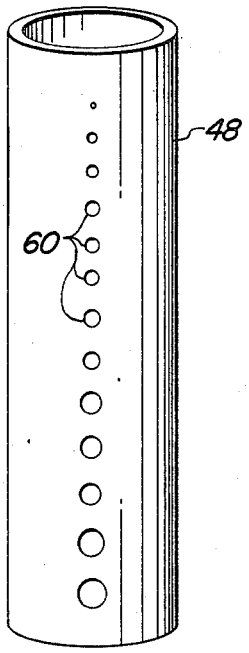
FIG. 4 is a perspective view of an outlet tube showing an alternative arrangement having a plurality of apertures formed in a vertical fashion with the larger diameter openings being located adjacent to the lower end wall.
Figure 5:
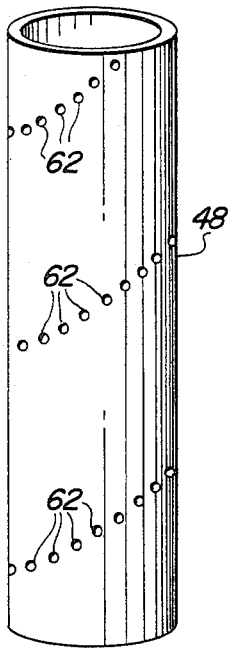
FIG. 5 is a perspective view of an outlet tube showing an alternative arrangement having a plurality of apertures arranged in a spiral fashion about the tube.

Referring to FIGS. 4 and 5, two additional alternatives for the peripheral opening 52 are shown. In FIG. 4, a plurality of apertures 60 are utilized which are arranged in a vertical fashion along the length of the outlet tube 48. The shape of the apertures 60 can vary but preferably is circular or elliptical. The diameters of the apertures 60 can increase from the top to the bottom of the outlet tube 48 to provide increased surface area in the lower portion of the combustion chamber 12. Such openings serve the same purpose as the tapered opening 56 shown in FIG. 3. It should be noted that all the apertures 60 can have the same diameter if desired or the arrangement can be altered such that the larger diameter holes are near the top of the outlet tube 48 while the smaller diameter holes are near the bottom. Such an arrangement might be useful when using the cyclone separator 10 to separate particles which tend to agglomerate as they are mixed. In FIG. 5, a plurality of apertures 62 are formed in the outlet tube 48 in a helical fashion. The apertures 62 are depicted as having a constant diameter although the diameters can increase or decrease as the apertures 62 progress toward the upper end of the outlet tube 48. The apertures 60 and 62 can also have a portion of their circumferances bowed outward to form a convex portion similar to convex portion 54 or 58. In addition, the apertures 62 can be elliptical in shape, rather than circular, should this be desired.

Figure 6:
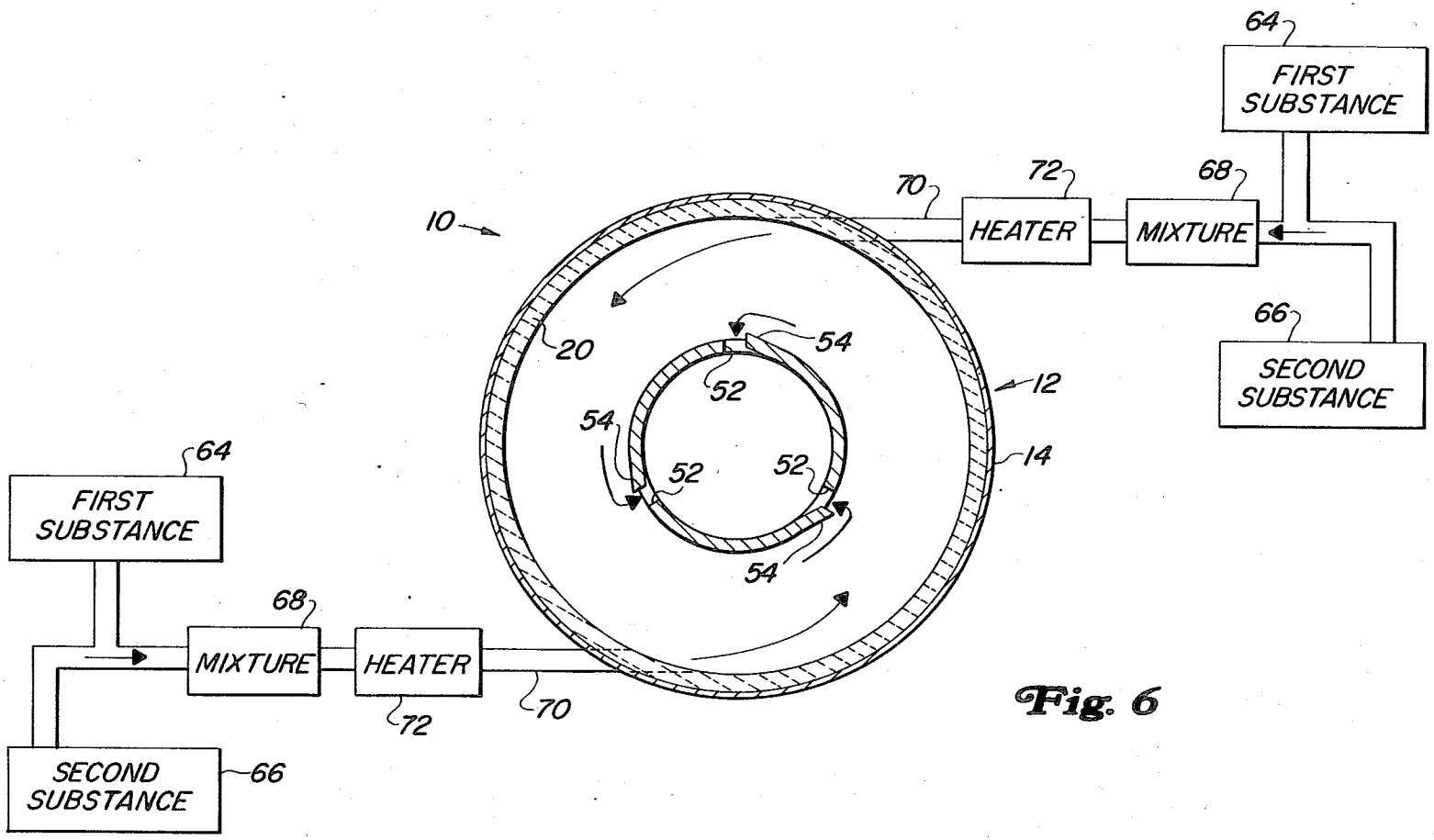
FIG. 6 is a top view of a cyclone separator showing two lines introducing a mixture of at least two substances.

Referring to FIG. 6, an alternative configuration is shown for introducing a mixture of a first substance 64 and a second substance 66 into the cyclone separator 10. The first substance 64, which can be a fuel, is mixed with a second substance 66, such as pressurized air, to form a mixture 68 which is routed through line 70 into the combustion chamber 12. The premixing, before introduction in the combustion chamber 12, can be advantageous in certain situations. FIG. 6 also shows the use of a heater 72 positioned between the mixture 68 and the cyclone separator 10 which can be utilized to preheat the mixture before its introduction. Such a feature is optional and can be used when desired. Lastly, FIG. 6 shows the use of two separate and distinct introduction points wherein the mixture 68 is introduced into the cyclone separator 10. By using two or more introduction inlet lines 70, one may be able to better control the distribution and circulation of the mixture within the cyclone separator 10.

While the invention has been described in conjunction with several specific embodiments, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A cyclone separator comprising:

(a) a cylindrical chamber closed off by a lower end wall and an upper end wall;

(b) a first inlet tangentially formed in a lower portion of said cylindrical chamber through which a first substance is fed;

(c) a second inlet tangentially formed in a lower portion of said cylindrical chamber above and at an inclined angle to said first inlet through which a second substance is fed, said first substance combining with said second substance to form a mixture which is circulated at a high velocity in an upwardly extending spiral path to promote intermixing of said first and second substances;

(d) an outlet formed in the outer perimeter of said cylindrical chamber through which one of said substances is removed; and (e) an outlet tube coaxially positioned within said cylindrical chamber which extends out through said upper end wall, said outlet tube having at least one peripheral opening formed therein which requires a substance to make an angular turn in order to enter said tube, said angular turn assisting in separating different size substances whereby essentially only common size substances can exit said cylindrical chamber through said tube.

2. The cyclone separator of claim 1 wherein a portion of said outlet tube adjacent to said peripheral opening is curved outward to increase the angular turn required for a substance to enter said tube.

3. A cyclone separator comprising:

(a) a combustion chamber having a cylindrical member closed off by an upper end wall;

(b) a fuel inlet tangentially formed in a lower portion of said combustion chamber through which a pressurized stream of carbonaceous material is fed;

(c) an air inlet tangentially formed in a lower portion of said combustion chamber above and at an inclined angle to said fuel inlet through which a pressurized stream of hot air is fed, said air combining with said fuel to form a mixture which is circulated at a high velocity in an upwardly extending spiral path to promote burning of said carbonaceous material to produce combustible gas and ash;

(d) an outlet formed in said upper end wall through which said ash is removed; and (e) an outlet tube coaxially positioned within said combustion chamber which extends out through said upper end wall, said tube having at least one peripheral opening formed therein which requires an angular turn by said spirally circulating combustible gas in order to enter said tube, said angular turn assisting in separating said combustible gas from said ash whereby essentially ash-free gas exits said combustion chamber through said outlet tube.

4. The cyclone separator of claim 3 wherein a portion of said tube adjacent to said peripheral opening is curved outward to increase the angular turn which said combustible gas must make in order to enter said tube.

5. The cyclone separator of claim 4 wherein said peripheral opening is a longitudinal slit having a uniform width.

6. The cyclone separator of claim 5 wherein two or more longitudinal slits are spaced about the periphery of said tube.

7. The cyclone separator of claim 5 wherein said longitudinal slit extends from a point adjacent said fuel inlet to a point adjacent said upper end wall of said combustion chamber.

8. The cyclone separator of claim 5 wherein said longitudinal slit has a length equal to at least 75% of the height of said combustion chamber.

9. The cyclone separator of claim 3 wherein said peripheral opening includes at least two apertures arranged in a vertical fashion.

10. The cyclone separator of claim 3 wherein said peripheral opening includes a plurality of apertures of increasing cross-sectional area arranged in a vertical fashion, the larger diameter apertures being formed adjacent to a lower portion of said combustion chamber.

11. The cyclone separator of claim 3 wherein said peripheral opening includes a plurality of apertures arranged in a spiral configuration about said tube.

12. A cyclone separator capable of effectively separating combustible gas from ash, comprising:

(a) a combustion chamber having a cylindrical member closed off by a lower end wall and an upper end wall;

(b) a fuel inlet tangentially formed in a lower portion of said combustion chamber through which a pressurized stream of carbonaceous material is fed;

(c) an air inlet tangentially formed in a lower portion of said combustion chamber above and at an inclined angle to said fuel inlet through which a pressurized stream of hot air is fed, said air combining with said fuel to form a mixture which is circulated at a high velocity in an upwardly extending spiral path to promote pyrolysis of said carbonaceous material to produce combustible gas and ash;

(d) an outlet formed in the outer perimeter of said upper end wall through which said ash is removed; and (e) an open ended outlet tube coaxially positioned within said combustion chamber which extends out through said upper end wall, said outlet tube having at least one tapered opening formed therein which requires an angular turn by said spirally circulating combustible gas in order to enter said tube, said angular turn assisting in separating said combustible gas from said ash whereby essentially ash-free gas passes out of said combustion chamber through said tube.

13. The cyclone separator of claim 12 wherein a portion of said tube adjacent to said tapered opening is curved outward to increase the angular turn which said combustible gas must make in order to enter said tube.

14. The cyclone separator of claim 13 wherein said tapered opening is a longitudinal slit which narrows toward said upper end wall of said combustion chamber.

15. The cyclone separator of claim 12 wherein said tapered opening is sized to expel combustible gas from said combustion chamber at a constant velocity along its entire length.

16. The cyclone separator of claim 13 wherein said tapered opening has a length equal to at least 75% of the height of said combustion chamber.

17. The cyclone separator of claim 12 wherein said fuel inlet is radially aligned with said tapered opening formed in said cylindrical tube.

18. A cyclone separator capable of effectively separating combustible gas from ash, comprising:

(a) a combustion chamber having a cylindrical member closed off by a lower end wall and an upper end wall;

(b) a plurality of fuel inlets tangentially formed in and equally spaced about a lower portion of said combustion chamber through which pressurized streams of pulverized carbonaceous material is fed;

(c) a plurality of air inlets tangentially formed in a lower portion of said combustion chamber above and at an inclined angle to said fuel inlets through which pressurized streams of hot air is fed, said air combining with said fuel to form a mixture which is circulated at a high velocity in an upwardly extending spiral path about the inside of said combustion chamber to promote burning of said carbonaceous material to produce combustible gas and ash;

(d) an outlet formed in the outer perimeter of said upper end wall through which said ash is removed; and (e) an outlet tube opened to the atmosphere and coaxially positioned within said combustion chamber, said outlet tube having a plurality of openings formed in the periphery thereof which necessitates an angular turn by said spirally circulating combustible gas in order to enter said tube, said angular turn assisting in separating said combustible gas from said ash whereby essentially ash-free gas passes out of said combustion chamber to the atmosphere.

19. The cyclone separator of claim 18 wherein a portion of said tube adjacent to said peripheral openings is curved outward to increase the angular turn which said combustible gas must make in order to enter said tube.

* * * * *